US007116281B2

(12) United States Patent
Rankin

(10) Patent No.: US 7,116,281 B2
(45) Date of Patent: Oct. 3, 2006

(54) UNIVERSAL DIPOLE WITH ADJUSTABLE LENGTH ANTENNA ELEMENTS

(75) Inventor: Charles A. Rankin, Smithtown, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 64 days.

(21) Appl. No.: 10/854,323

(22) Filed: May 26, 2004

(65) Prior Publication Data

US 2005/0264464 A1 Dec. 1, 2005

(51) Int. Cl.
*H01Q 9/16* (2006.01)
*H01Q 21/26* (2006.01)

(52) U.S. Cl. ..... 343/820; 343/893; 343/747; 343/821; 343/861; 343/884; 343/797

(58) Field of Classification Search ..... 343/821, 343/747, 797, 861, 862, 884, 809, 752, 725, 343/820, 893, 810
See application file for complete search history.

(56) References Cited

U.S. PATENT DOCUMENTS 3,396,398 A * 8/1968 Dunlavy, Jr. ..... 343/814
3,618,105 A * 11/1971 Bruene et al. ..... 343/747
4,369,449 A * 1/1983 MacDougall ..... 343/790
4,485,385 A * 11/1984 Ralston ..... 343/795
4,611,214 A * 9/1986 Campbell et al. ..... 343/790
5,532,708 A * 7/1996 Krenz et al. ..... 343/795
6,933,907 B1 * 8/2005 Shirosaka et al. ..... 343/810

* cited by examiner

*Primary Examiner*—Tho Phan
*Assistant Examiner*—Chuc Tran
(74) *Attorney, Agent, or Firm*—Fay Kaplun & Marcin, LLP.

(57) ABSTRACT

Described is a universal dipole which may include a feed line coupled to a first fitting; a balun coupled to a second fitting; a first variable length antenna element coupled to the first fitting; a second variable length antenna element coupled to the second fitting; a support plate holding the feed line and the balun at a fixed spacing, the support plate including a short circuit path between the feed line and the balun; and a sliding short assembly attachable between the feed line and the balun to create a short circuit at variable distances along the feed line and the balun.

18 Claims, 18 Drawing Sheets

Far-field amplitude of AMPS GSM Universal Dipole 1- elh_+00_co_00.nsi

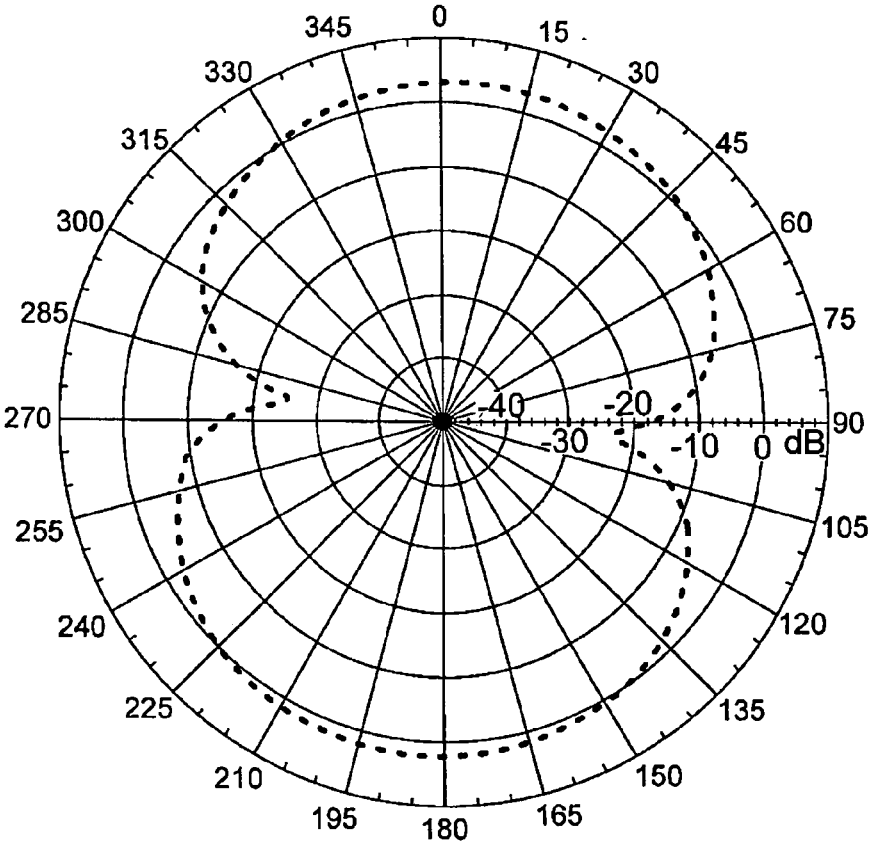

Far-field amplitude. Eprincipal: Linear, Tau = 0.000 deg
Gain = 3.078 dBi
Max far-field (global) = 4.692 dB, Max far- field (plot) = 4.692 dB
Normalization: Reference, Network offset = 0.000 dB
Hpeak at: 8.000 deg, Vpeak at: 0.000 deg,
Plot centering: On Average Gain = -1.24 dBi
Description: AMPS/GSM Universal Dipole # 1
EL, PHI=0, Co-pol
Tx Ant: SAS
Operator: CR, 7 - 23 - 203, M119B0
Ref: SAS NSI2000 V3.0.56, Filename: C: DATA MISC ANTENNA\Dipole Test\Pre_Oats\
Measurement date/time: 7/23/03 1:16:58 PM, Filetype: NSI - 97

SEE FIG. 11B

F I G. 11A

↑ SEE FIG. 11A

Far-field Cut Analysis:

-3. dB beam width: 82.23 deg
-6. dB beam width : 112.62 deg
-10. dB beam width: 138.03 deg
Left Sidelobe: -0.12 dB at -174.000 deg
Right Sidelobe: Not Found Far-field display setup Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1

Selected beam(s) 1 of 19

| Beam | Frequency | Azimuth | Switch 1 | Pol |
|---|---|---|---|---|
| Beam Name 2 | .881 GHz | Azimuth | Switch 1 | Single - pol |

Measured data:

Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1
Far field distance: 118.11024 in Measurement type: FF Spherical Az-over -El
Scan options: CV Off, CP On, Bi-dir Off, V-scan
Beamset smear: 2.000 deg RF system:
Integration time: 1.000 mSec
Scan speed: 5.49451 deg/sec
Drift during scan ( final - initial )
Amp/ Phase initial = 4.64 dB, -179.1 deg
Amp/ Phase drift = 0.00dB, 0.3 deg

FIG. 11B

Far-field amplitude of AMPS GSM Universal Dipole 1- elh_+00_co_00.nsi

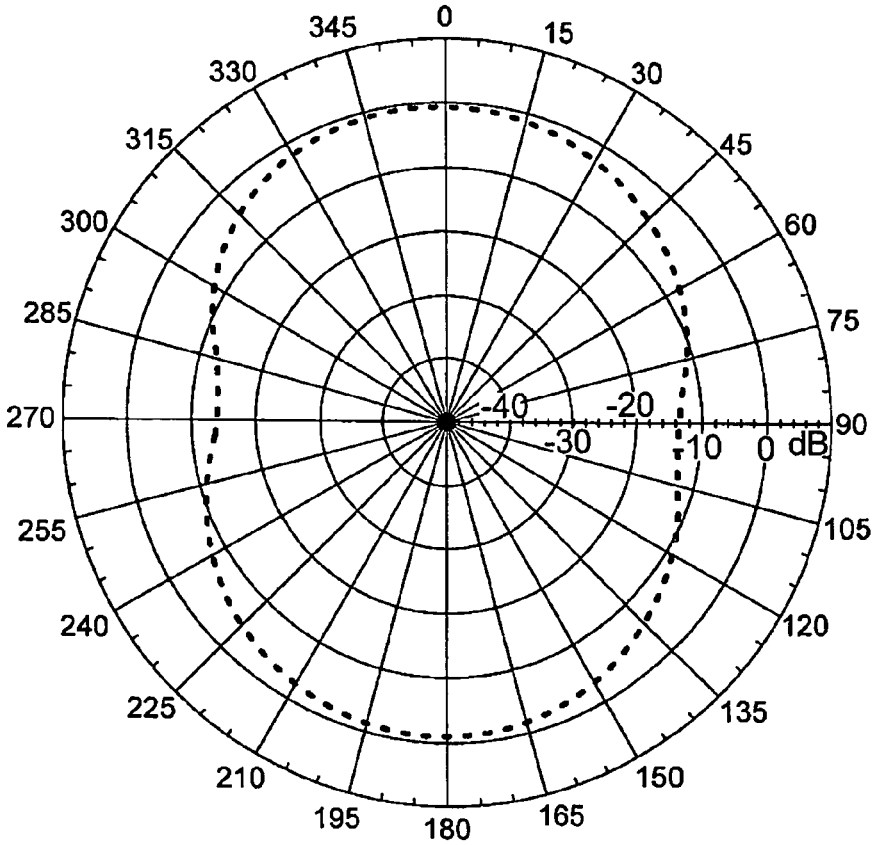

Far-field amplitude. Eprincipal: Linear, Tau = 0.000 deg
Gain = -0.471 dBi
Max far-field (global) = -3.180 dB, Max far- field (plot) = -3.180 dB
Normalization: Reference, Network offset = 0.000 dB
Hpeak at: 0.000 deg, Vpeak at: 0.000 deg,
Plot centering: On Average Gain = -5.00 dBi
Description: AMPS/GSM Universal Dipole # 1
EL, PHI=0, Co-pol
Tx Ant: SAS
Operator: CR, 7 - 23 - 203, M119B0
Ref: SAS NSI2000 V3.0.56, Filename: C: DATA MISC ANTENNA\Dipole Test\Pre_Oats\
Measurement date/time: 7/23/03 1:16:58 PM, Filetype: NSI - 97

SEE FIG. 12B

F I G. 12A

↑ SEE FIG. 12A

Far-field Cut Analysis:

-3. dB beam width: 78.67 deg
-6. dB beam width : 111.35 deg
-10. dB beam width: 144.18 deg
Left Sidelobe: -1.50 dB at -178.000 deg
Right Sidelobe: Not Found Far-field display setup Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1

Selected beam(s) 1 of 19

| Beam | Frequency | Azimuth | Switch 1 | Pol |
|---|---|---|---|---|
| Beam Name 7 | .942 GHz | Azimuth | Switch 1 | Single - pol |

Measured data:

Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1
Far field distance: 118.11024 in Measurement type: FF Spherical Az-over -El
Scan options: CV Off, CP On, Bi-dir Off, V-scan
Beamset smear: 2.000 deg RF system:
Integration time: 1.000 mSec
Scan speed: 5.49451 deg/sec
Drift during scan ( final - initial )
Amp/ Phase initial = 4.64 dB, -179.1 deg
Amp/ Phase drift = 0.00dB, 0.3 deg

F I G. 12B

Far-field amplitude of DCS PCS Universal Dipole 1- elh_+00_co_00.nsi

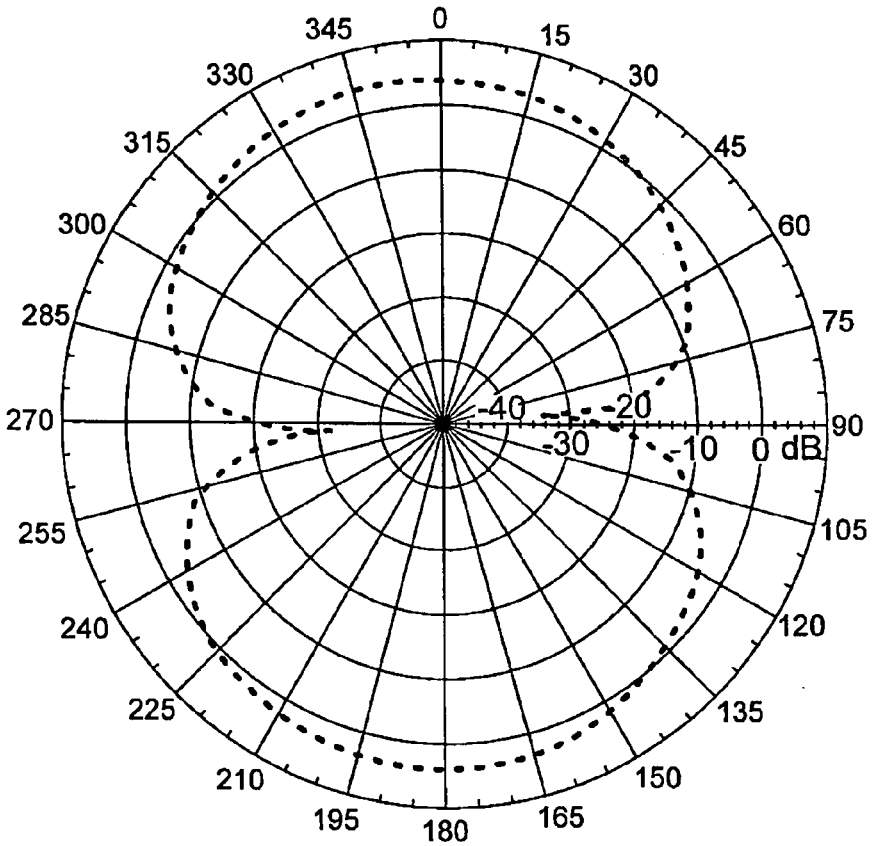

Far-field amplitude. Eprincipal: Linear, Tau = 0.000 deg
Gain = 4.148 dBi
Max far-field (global) = -12.370 dB, Max far- field (plot) = -12.370 dB
Normalization: Reference, Network offset = 0.000 dB
Hpeak at: -6.000 deg, Vpeak at: 0.000 deg,
Plot centering: On Average Gain = -0.47 dBi
Description: DCS/PCS Universal Dipole # 1
EL, PHI=0, Co-pol
Tx Ant: 3115
Operator: CR, 7 - 23 - 203, M119B0
Ref: 3160

NSI2000 V3.0.56, Filename: C: DATA MISC ANTENNA\ Dipole Test\Pre_Oats\
Measurement date/time: 7/23/03 9:54:01 AM, Filetype: NSI - 97

SEE FIG. 13B

F I G. 13A

↑ SEE FIG. 13A

Far-field Cut Analysis:

-3. dB beam width: 79.27 deg
-6. dB beam width : 108.76 deg
-10. dB beam width: 134.60 deg
Left Sidelobe: -0.06 dB at -176.000 deg
Right Sidelobe: Not Found Far-field display setup Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1

Selected beam(s) 1 of 11

| Beam | Frequency | Azimuth | Switch 1 | Pol |
|---|---|---|---|---|
| Beam Name 5 | 1.837 GHz | Azimuth | Switch 1 | Single - pol |

Measured data:

Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1
Far field distance: 118.11024 in Measurement type: FF Spherical Az-over -El
Scan options: CV Off, CP On, Bi-dir Off, V-scan
Beamset smear: 2.000 deg RF system:
Integration time: 1.000 mSec
Scan speed: 8.47458 deg/sec
Drift during scan ( final - initial )
Amp/ Phase initial = -11.21 dB, -137.3 deg
Amp/ Phase drift = 0.01dB, -0.2 deg

FIG. 13B

Far-field amplitude of DCS PCS Universal Dipole 1- elh_+00_co_00.nsi

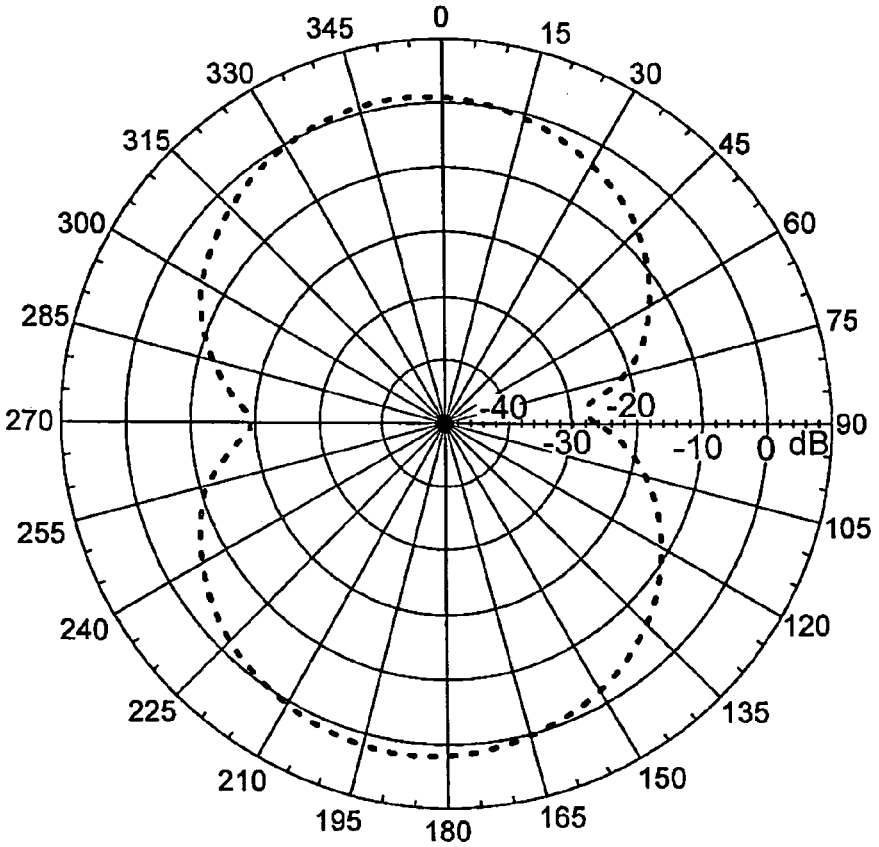

Far-field amplitude. Eprincipal: Linear, Tau = 0.000 deg
Gain = 1.911 dBi
Max far-field (global) = -15.209 dB, Max far- field (plot) = -15.209 dB
Normalization: Reference, Network offset = 0.000 dB
Hpeak at: -170.000 deg, Vpeak at: 0.000 deg,
Plot centering: On Average Gain = -3.94 dBi
Description: DCS/PCS Universal Dipole # 1
EL, PHI=0, Co-pol
Tx Ant: 3115
Operator: CR, 7 - 23 - 203, M119B0
Ref: 3160

NSI2000 V3.0.56, Filename: C: DATA MISC ANTENNA\ Dipole Test\Pre_Oats\
Measurement date/time: 7/23/03 9:54:01 AM, Filetype: NSI - 97

SEE FIG. 14B

F I G. 14A

SEE FIG. 14A

Far-field Cut Analysis:

-3. dB beam width: Not Found
-6. dB beam width : Not Found
-10. dB beam width: Not Found
Left Sidelobe: Not Found
Right Sidelobe: -0.65 dB at -8.000 deg Far-field display setup Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1

Selected beam(s) 1 of 11

| Beam | Frequency | Azimuth | Switch 1 | Pol |
|---|---|---|---|---|
| Beam Name 10 | 1.96 GHz | Azimuth | Switch 1 | Single - pol |

Measured data:

Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1
Far field distance: 118.11024 in Measurement type: FF Spherical Az-over -El
Scan options: CV Off, CP On, Bi-dir Off, V-scan
Beamset smear: 2.000 deg RF system:
Integration time: 1.000 mSec
Scan speed: 8.47458 deg/sec
Drift during scan ( final - initial )
Amp/ Phase initial = -11.21 dB, -137.3 deg
Amp/ Phase drift = 0.01dB, -0.2 deg

F I G. 14B

Far-field amplitude of ISM 2p4 Universal Dipole - elh_+00_co_00.nsi

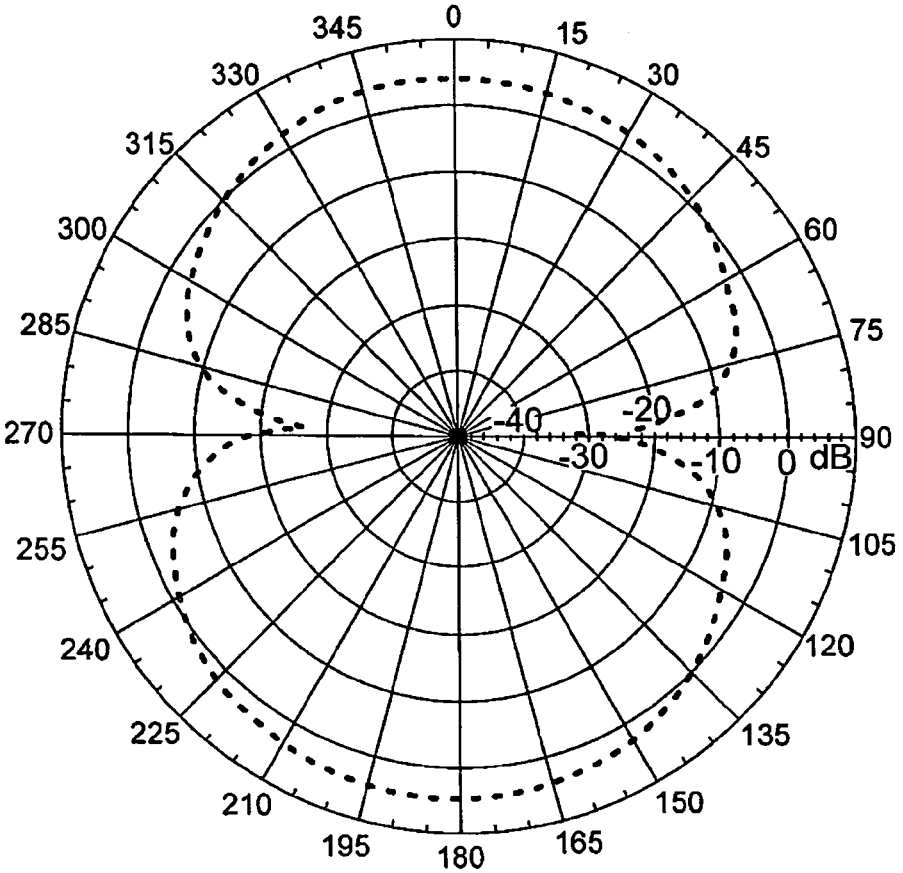

Far-field amplitude. Eprincipal: Linear, Tau = 0.000 deg
Gain = 4.357 dBi
Max far-field (global) = -17.614 dB, Max far- field (plot) = -17.6149 dB
Normalization: Reference, Network offset = 0.000 dB
Hpeak at: -178.000 deg, Vpeak at: 0.000 deg,
Plot centerig: On Average Gain = -0.09 dBi
Description: ISM 2.4 GHz Universal Dipole # 1
EL, PHI=0, Co-pol
Tx Ant: 3115
Operator: CR, 7 - 23 - 203, M119B0
Ref: 3160

NSI2000 V3.0.56, Filename: C: DATA MISC ANTENNA\ Dipole Test\Pre_Oats\
Measurement date/time: 7/23/03 10:41:14 AM, Filetype: NSI - 97

↓ SEE FIG. 15B

F I G. 15A

↑ SEE FIG. 15A

Far-field Cut Analysis:

-3. dB beam width: Not Found
-6. dB beam width : Not Found
-10. dB beam width: Not Found
Left Sidelobe: Not Found
Right Sidelobe: -0.30 dB at -0.000 deg Far-field display setup Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1

Selected beam(s) 1 of 3

| Beam | Frequency | Azimuth | Switch 1 | Pol |
|---|---|---|---|---|
| Beam Name 2 | 2.44 GHz | Azimuth | Switch 1 | Single - pol |

Measured data:

Azimuth ( deg )
Span = 360.000 deg, Center = 0.000 deg, #pts = 181
Start = -180.000 deg, Stop = 180.000 deg, Delta = 2.000 deg
Elevation ( deg )
Center = 0.000 deg, # pts = 1
Far field distance: 118.11024 in Measurement type: FF Spherical Az-over -El
Scan options: CV Off, CP On, Bi-dir Off, V-scan
Beamset smear: 2.000 deg RF system:
Integration time: 1.000 mSec
Scan speed: 18.51852 deg/sec
Drift during scan ( final - initial )
Amp/ Phase initial = -19.40 dB, 11.3 deg
Amp/ Phase drift = 0.13 dB, 0.3 deg

FIG. 15B

UNIVERSAL DIPOLE WITH ADJUSTABLE LENGTH ANTENNA ELEMENTS

BACKGROUND INFORMATION

In a wireless communication network, a device may include or be attached to a dipole antenna in order to receive and/or transmit communications over the network. However, there may be a need to receive and/or transmit signals at different frequencies. In a traditional network, such a device would need to include a dipole antenna set to accommodate the various frequencies. The dipole antenna set includes multiple antennas of varying lengths in order to receive and/or transmit the communications at the different frequencies. These dipole sets are very expensive and tend to include antenna lengths which the user does not need.

SUMMARY OF THE INVENTION

The present invention relates to a universal dipole which may include (a) a feed line coupled to a first fitting; a balun coupled to a second fitting, (b) a first variable length antenna element coupled to the first fitting and (c) a second variable length antenna element coupled to the second fitting. In addition, the universal dipole may include (d) a support plate holding the feed line and the balun at a fixed spacing. The support plate includes a short circuit path between the feed line and the balun. Furthermore, the universal dipole may include (e) a sliding short assembly attachable between the feed line and the balun to create a short circuit at variable distances along the feed line and the balun.

BRIEF DESCRIPTION OF THE DRAWINGS

FIG. 11 shows an exemplary antenna pattern for an AMPS signal at 881 MHz;

FIG. 12 shows an exemplary antenna pattern for a GSM signal at 942 MHz;

FIG. 13 shows an exemplary antenna pattern for a DCS signal at 1837 MHz;

FIG. 14 shows an exemplary antenna pattern for a PCS signal at 1960 MHz;

FIG. 15 shows an exemplary antenna pattern for an ISM signal at 2.4 GHz;

DETAILED DESCRIPTION

Figure 1:
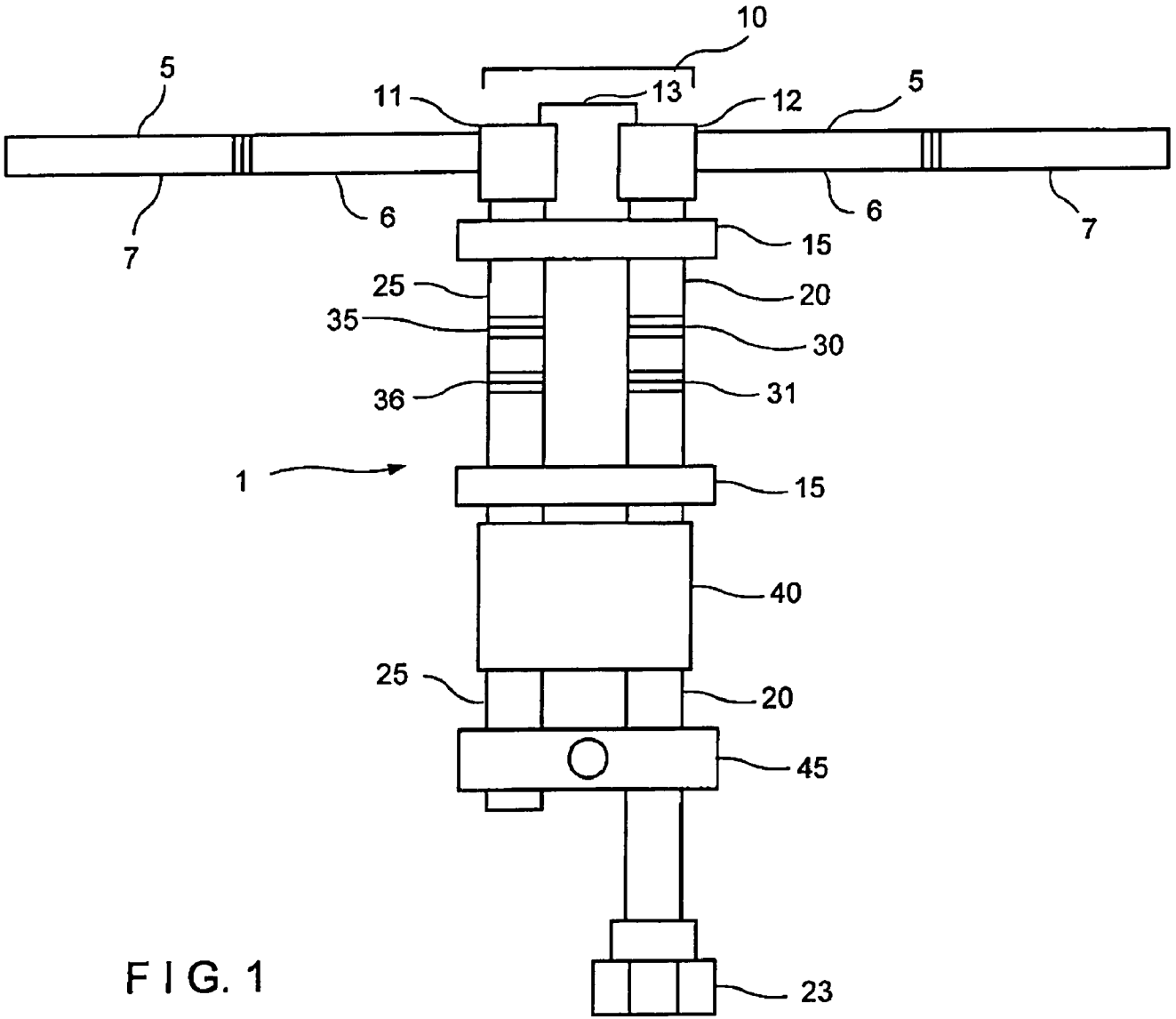
FIG. 1 shows a first exemplary embodiment of the universal dipole according to the present invention.

The present invention may be further understood with reference to the following description and the appended drawings, wherein like elements are provided with the same reference numerals. A dipole antenna is a straight electrical conductor which measures one-half of the wavelength of interest from end to end. The conductor is generally connected at the center to a radio-frequency ("RF") feed line to propagate the received signal to the device which is attached to the antenna or in the opposite direction for a signal which is to be transmitted. The feed line may be an unbalanced line such as a coaxial cable. Where such an unbalanced feed line is used, a balun may be inserted where the feed line joins the antenna to balance the signal.

Since the dipole antenna has an ideal measurement of one-half the wavelength of interest, signals of different frequencies require dipole antennae of different lengths. Similarly, the different signals require baluns of differing lengths. Thus, in a traditional antenna system dipole sets having antennas of different lengths are provided to accommodate signals at different frequencies.

The exemplary embodiments of the universal dipole of the present invention alleviate the need to supply expensive dipole sets when the device attached to the antenna is to transmit and/or receive signals at different frequencies. The exemplary embodiments of the universal dipole allow for a single adjustable dipole antenna to accommodate signals of varying frequencies, i.e., the lengths of the antenna and the balun are adjustable to accommodate the different wavelengths.

FIG. 1 shows a first exemplary embodiment of the universal dipole 1. The universal dipole 1 will be described and include various dimensions for the receipt and transmission of signals for the Advanced Mobile Phone System ("AMPS") which uses the 800 MHz frequency band (approximately 824–849 MHz), the Global System for Mobile Communication ("GSM") which uses the 900 MHz frequency band, the Digital Cellular System ("DCS") which uses the 1800 MHz frequency band, the Personal Communication Services ("PCS") which uses the 1900 MHz frequency band and the Industrial, Scientific and Medical ("ISM") frequency bands of 2.4 GHz. Those of skill in the art will understand that these frequency bands were selected only for exemplary purposes and that a universal dipole according to the present invention may be constructed and used for any number of frequency bands.

The universal dipole 1 includes antenna elements 5, a center section 10, a feed line 20 and a balun 25. The antenna elements 5 are constructed of one or more straight pieces of conducting material. In the example of FIG. 1, each of the antennal elements 5 are constructed of two (2) conducting elements 6 and 7. Each of the conducting elements 6 and 7 includes a threaded male end and a threaded female end. A first conducting element 6 may be secured to the center section 10 by screwing the threaded male end into a threaded female fitting of the center section 10. A second conducting element 7 may be secured to the first conducting element 6 by screwing the male end of the second conducting element 7 into the female end of the first conducting element 6. Thus, the length of the antenna elements 5 may be varied using any number of conducting elements 6 and 7, including the use of no conducting elements.

In the examples provided below, the different universal dipole embodiments will include embodiments with no conducting elements, one conducting element and two conducting elements. However, there may be embodiments where any number of conducting elements are combined to provide the desired length for the antenna elements 5 of the exemplary embodiment of the present invention.

Those of skill in the art will understand that threaded male and female ends of conducting elements 6 and 7 are only one exemplary manner of securing multiple conducting elements. Other examples include fitted ends, releaseable compression fittings, radial screws or thumbscrews, etc. Any manner of releaseably connecting one or more conducting elements such that the length of the antenna element 5 may be varied.

An example of a conducting element 6 and 7 may be a male/female aluminum hexagonal standoff of the size 4–40 3/16 by 1 inch. The hex standoff material is commercially available in various sizes and in a male/female configuration allowing for easy attachment and removal to each other and the center section 10. However, any type of conducting material that is generally used in an antenna may be used for the conducting elements 6 and 7. In addition, the length and diameter may be varied based on the desired response of the universal dipole. Furthermore, in one exemplary embodiment, the conducting elements 6 and 7 of various lengths may be covered in shrink tubing. For example, as shown in FIG. 1, conducting elements 6 and 7 may be covered in shrink tubing which makes them one integral antenna element 5 that is attached and removed in one piece from the center section 10.

Figure 2:
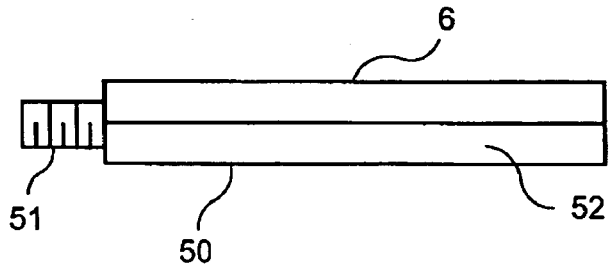
FIG. 2 shows a hexagonal standoff which may be used as a conducting element of the universal dipole according to the present invention.
Figure 4:
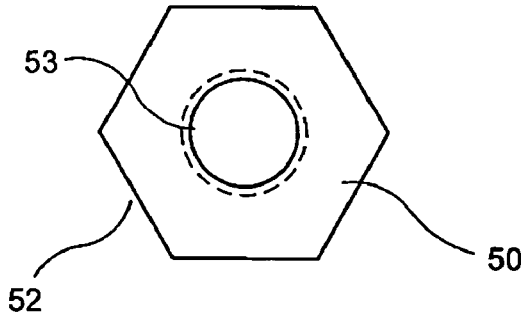
FIG. 4 shows a cross-sectional view of the hexagonal standoff of FIG. 2.

FIG. 2 shows a hexagonal standoff 50 which may be used as the conducting element 6 of the universal dipole 1. The hexagonal standoff 50 includes a male end 51 which may be screwed into the center section 10 and a hexagonal body 52. FIG. 4 shows a cross-sectional view of the hexagonal standoff 50 of FIG. 2. This view shows the hexagonal body 52 and the threaded female end 53 which may accept the male end 51 of another hexagonal standoff.

Figure 3:
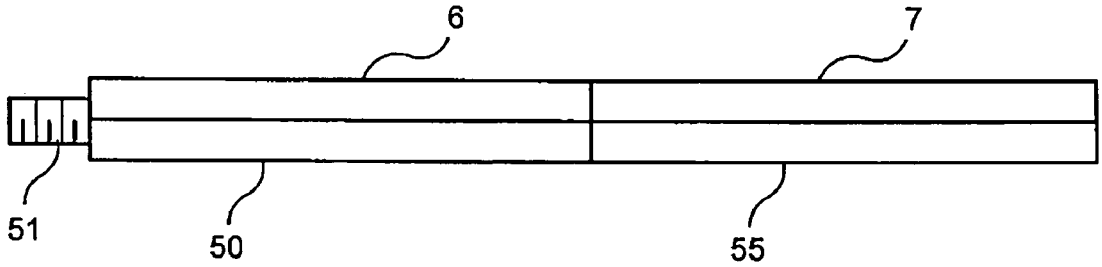
FIG. 3 shows two connected hexagonal standoffs which may be used as a conducting element of the universal dipole according to the present invention.

FIG. 3 shows two connected hexagonal standoffs 50 and 55 which may be used as conducting elements 6 and 7 of the universal dipole 1. In this example, hexagonal standoff 50 includes the same threaded male end 51 and hexagonal body 52 as described above. However, the male end (not shown) of hexagonal standoff 55 is screwed into the female end (not shown) of hexagonal standoff 50 creating a longer antenna element 5.

The center section 10 is also constructed of a conducting material, e.g., brass. The center section 10 is constructed of a conducting material because it contributes to the length of the universal dipole antenna 1. For example, for particular wavelengths, there may be no conducting elements 6 and 7 attached to the center section 10. The center section 10 may contribute the entire length of the antenna 1. The center section 10 may include two fittings 11 and 12 which are connected via a connector 13 which may be soldered, welded, etc. to hold the fittings 11 and 12 in relation to each other.

Each of the fittings 11 and 12 may include a threaded female portion or other connection device to accept the conducting elements 6 of the antenna elements 5. The fitting 11 will include an opening for insertion of the balun 25 and the fitting 12 will include an opening for the insertion of the feed line 20. The fittings 11 and 12 may also include a manner of securing the balun 25 and the feed line 20 to the respective fittings 11 and 12, e.g., a compression screw, a compression fitting, a solder accepting portion, etc.

The feed line 20 and the balun 25 may be a conductor such as a semi-rigid coaxial cable, e.g., RG-141. As described above, the feed line 20 is to conduct the received signals from the antenna elements 5 to the attached device or conduct the signals to be transmitted from the device to the antenna elements 5. The feed line 20 may also include a connector 23 (e.g., an SMA connector) for the feed line 20 to be connected to the device. The balun 25 is used to balance the RF current distribution on the antenna elements 5. While the feed line 20 is shown as being connected to the fitting 12, the center conductor of the feed line 20 is also connected to the fitting 11 in order to balance the signals received from each of the antenna elements 5.

Figure 5:
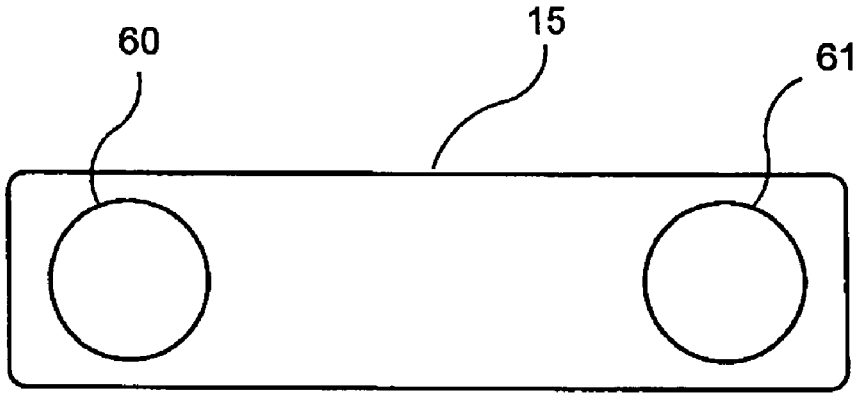
FIG. 5 shows a top view of the spacers which may be used to construct the universal dipole according to the present invention.

The further elements of the universal dipole 1 include spacers 15, a support plate 40, and a sliding short assembly 45. FIG. 5 shows a top view of the spacers 15 which may be used to construct the universal dipole 1. The spacers 15 may be constructed from a rigid or semi-rigid non-conducting material (e.g., plastic, ceramic, etc.). The spacers 15 include vias 60 and 61 for the feed line 20 and the balun 25 to be fed through. The spacers 15 are used to maintain a fixed distance relationship between the feed line 20 and the balun 25 as shown in FIG. 1. The spacers 15 may also add to the rigidity of the universal dipole 1.

The support plate 40 further maintains the fixed distance between the feed line 20 and the balun 25 and adds support and rigidity to the universal dipole 1. The support plate 40 also creates a short circuit between the feed line 20 and the balun 25. As described above, the operating characteristics of the universal dipole 1 depend on the length of the antenna elements 5 and the relationship between the feed line 20 and the balun 25. The support plate 40 provides a short circuit path between the feed line 20 and the balun 25 which defines the maximum distance relationship between the feed line 20 and the balun 25.

The sliding short assembly 45 provides for a movable assembly that places the short circuit between the feed line 20 and the balun 25 at variable positions. The sliding short assembly 45 is shown in FIG. 1 in its storage position. As described above, the support plate 40 defines the maximum distance relationship between the feed line 20 and the balun 25. The storage position is greater than this maximum distance and is used for the storage of the sliding short assembly 45.

When in use, the sliding short assembly 45 is moved into position along the feed line 20 and the balun 25. For example, the sliding short assembly 45 may be moved into position 30 on the feed line 20 and position 35 on the balun 25 to create the short circuit at this distance which is shorter than the maximum distance presented by the support plate 40 short circuit. Similarly, the sliding short assembly 45 may be moved into position 31 on the feed line 20 and position 36 on the balun 25 to create the short circuit at this distance.

The variable feed line 20 and balun 25 short circuit distance may be used in conjunction with the variable antenna element 5 distance to create the desired operating characteristics of universal dipole 1. Examples of such variable distances will be described in greater detail below.

The exemplary feed line 20 and balun 25 of FIG. 1 show two variable positions 30, 31 and 35, 36, respectively. However, it should be understood that the feed line 20 and balun 25 may have any number of variable positions where the sliding short assembly 45 may be attached to create the short circuit between the feed line 20 and balun 25.

Figure 6:
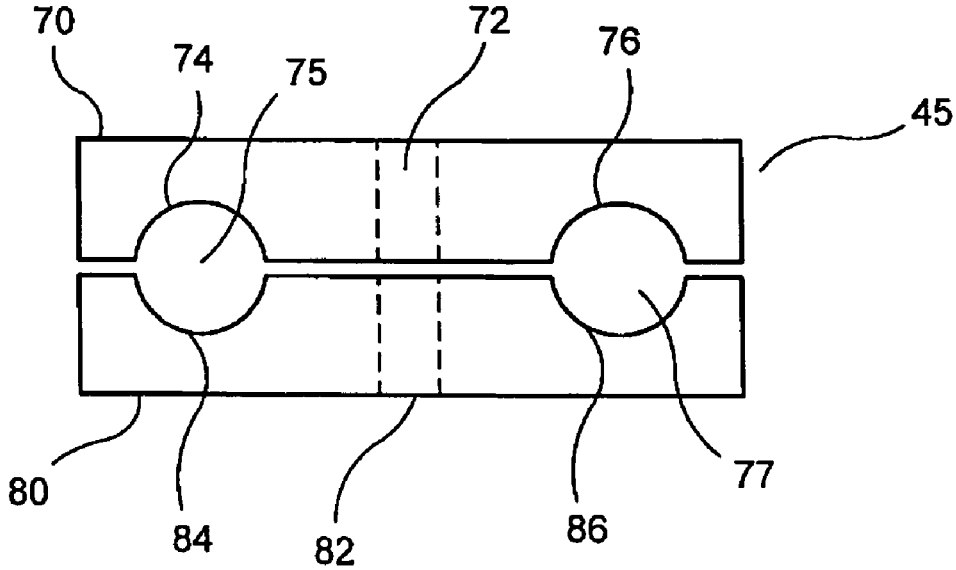
FIG. 6 shows a side view of an exemplary sliding short assembly of the universal dipole according to the present invention.

FIG. 6 shows a side view of an exemplary sliding short assembly 45 of the universal dipole 1. The exemplary sliding short assembly 45 includes a top portion 70 and a bottom portion 80 which are both constructed of a conducting material. The top portion 70 may be attached to the bottom portion 80 by, for example, a screw inserted into the respective vias 72 and 82. As shown by FIG. 6, when attached the top portion 70 and the bottom portion 80 form two vias 75 and 77. The screw may be loose to allow the sliding short assembly 45 to be moved into position on the feed line 20 and balun 25, e.g., positions 30, 35 and 31, 36. The screw may then be tightened to allow the sliding short assembly 45 to clamp down on the feed line 20 and balun 25, such that the inner faces (74, 84 and 76, 86) of the sliding short assembly 45 forming the vias 75 and 77 contact the feed line 20 and balun 25 creating the short circuit.

The sliding short assembly 45 shown in FIG. 6 is only exemplary and those of skill in the art will understand that there are numerous embodiments of assemblies which may be secured to the feed line 20 and the balun 25 to create a short circuit at variable distances.

Also, as described above, the feed line 20 and the balun 25 may be constructed of coaxial cable which may have an insulating jacket. Where the feed line 20 and the balun 25 are constructed from coaxial cable having an insulating jacket, the insulation may have to be stripped at the various locations along the feed line 20 and the balun 25 where the permanent short circuit of the support plate 40 is created and the variable locations where the sliding short assembly 45 may be attached in order that the support plate 40 and/or the sliding short assembly 45 contact the outer conductor of the coaxial cable.

Figure 7:
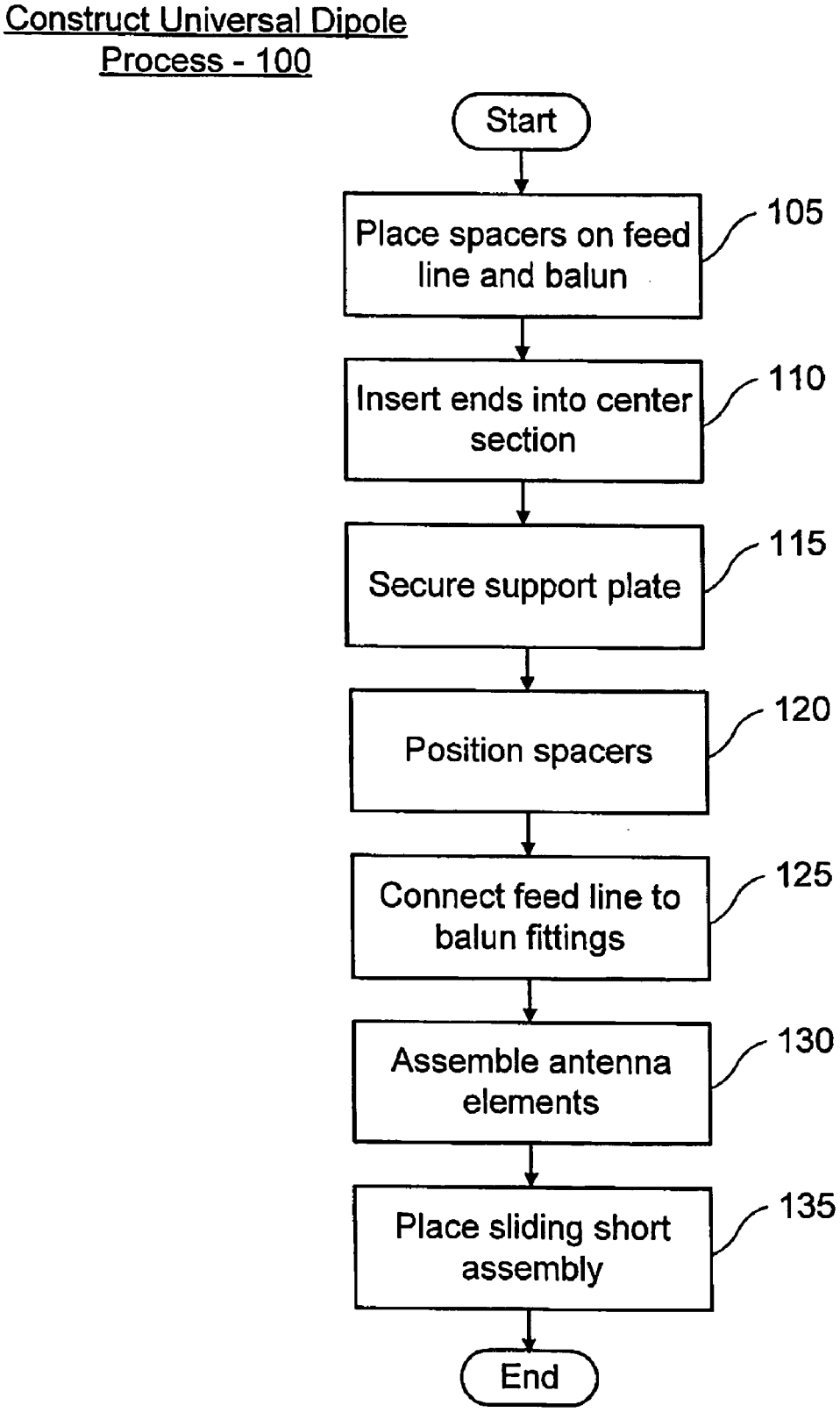
FIG. 7 shows an exemplary process for constructing the universal dipole according to the present invention.

FIG. 7 shows an exemplary process 100 for constructing the universal dipole 1 including exemplary dimensions as described above. In step 105 the two (2) spacers 15 are placed on the feed line 20 and the balun 25. In step 110, the ends of the feed line 20 and the balun 25 are inserted into the respective fittings 11 and 12 of the center section 10. The feed line 20 and the balun 25 are secured to the center section 10 by, for example, tightening a screw into the fittings 11 and 12 which compresses the fittings 11 and 12 onto feed line 20 and the balun 25.

In step 115, the support plate 40 is secured to the feed line 20 and the balun 25. The support plate 40 may be installed at 4.92 inches from the bottom of the center section 10. This is the location of the permanent short between the feed line 20 and the balun 25. The support plate 40 may be secured by soldering the support plate 40 to the feed line 20 and the balun 25. The first spacer 15 may then be positioned at the top edge of the support plate 40 and the second spacer may be positioned at the lower edge of the center section 10 (step 120). The spacers 15 may be secured to the outside of the feed line 20 and the balun 25 using, for example, an adhesive.

In step 125, the center conductor of the feed line 20 is connected to the fitting 11 to which the balun 25 is connected. As described above, the feed line is connected to the balun 25 portion of the center section 10 in order to balance the signal received from the antenna elements 5. The connection may be accomplished by bending the center conductor of the feed line 20 and fitting it into a slot (not shown) of the fitting 11, trimming the conductor, as required, and soldering the conductor to the fitting 11.

The next step 130 is to assemble the antenna elements 5. As described above, the length of the antenna elements 5 depend on the wavelength of the signals of interest. Using the example of the aluminum hex standoffs described above for the conducting elements 6 and 7, the AMPS/GSM band would use two (2) standoffs for each of the antenna elements 5, the DCS/PCS band would use one (1) standoff for each of the antenna elements 5 and the ISM band would not require any standoffs, i.e., the fittings 11 and 12 of the center section 10 provide the required element length for the ISM band. As described above, the conducting elements 6 may be secured to the fittings 11 and 12 and any additional conducting elements 7 may be secured to the conducting elements 6.

The sliding short assembly 45 is then placed at the required location (step 135). For example, for the AMPS/GSM band, the sliding short assembly 45 may stay in the storage position because the permanent short of the support plate 40 is used. The DCS/PCS band may have the sliding short assembly 45 create a short circuit at a distance of 2.44 inches from the bottom edge of the center section 10, e.g., the sliding short assembly 45 is placed between position 31 of the feed line 20 and position 36 of the balun 25. The ISM band may have the sliding short assembly 45 create a short circuit at a distance of 1.14 inches from the bottom edge of the center section 10, e.g., the sliding short assembly 45 is placed between position 30 of the feed line 20 and position 35 of the balun 25.

At the end of process 100, an exemplary universal dipole 1 is complete. However, as described above, the universal dipole 1 may be altered by changing the lengths of the antenna elements 5 and the position of the sliding short assembly 45 to accommodate various bands of interest.

Furthermore, the various configurations of the universal dipole 1 may be tested to verify that the operating characteristics match the expected characteristics. The universal dipole 1 may be tested against both the expected VSWR (S11) and the Antenna Patterns. VSWR (S11) is the scattering parameter designation for the transmission coefficient of return loss which is designated as reflected power/incident power.

Figure 8:
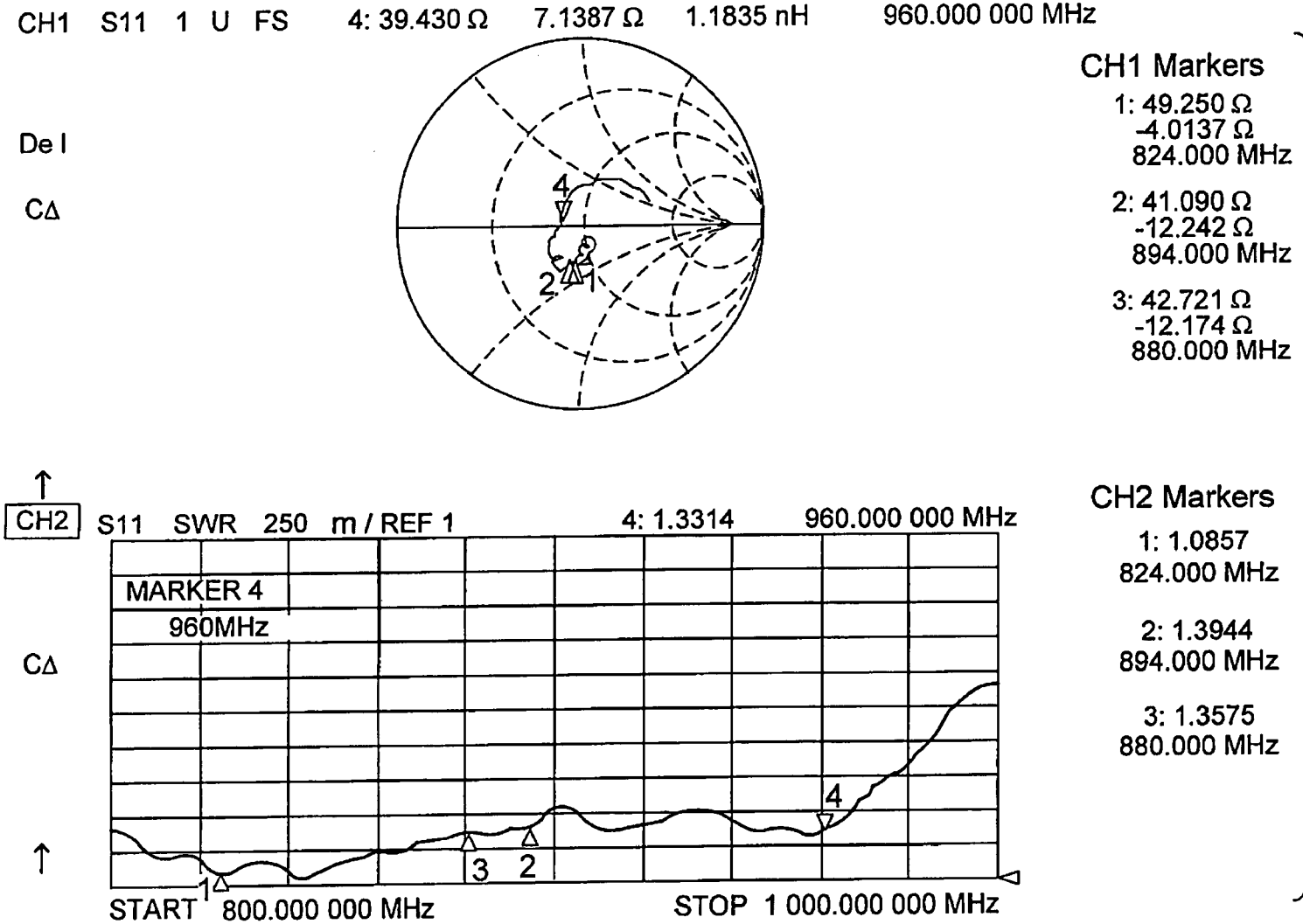
FIG. 8 shows an exemplary VSWR (S11) for the AMPS/GSM band.
Figure 9:
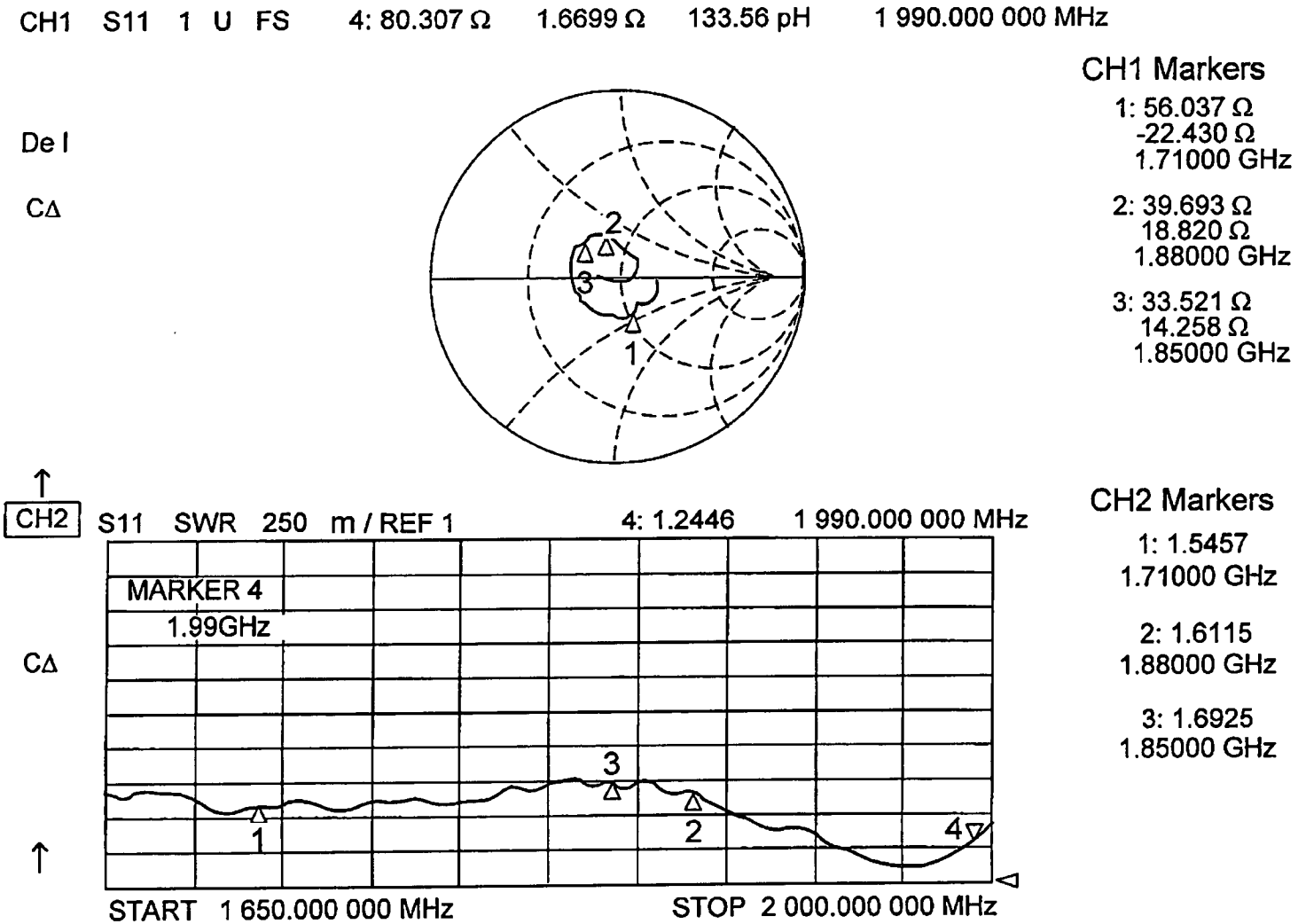
FIG. 9 shows an exemplary VSWR (S11) for the DCS/PCS band.
Figure 10:
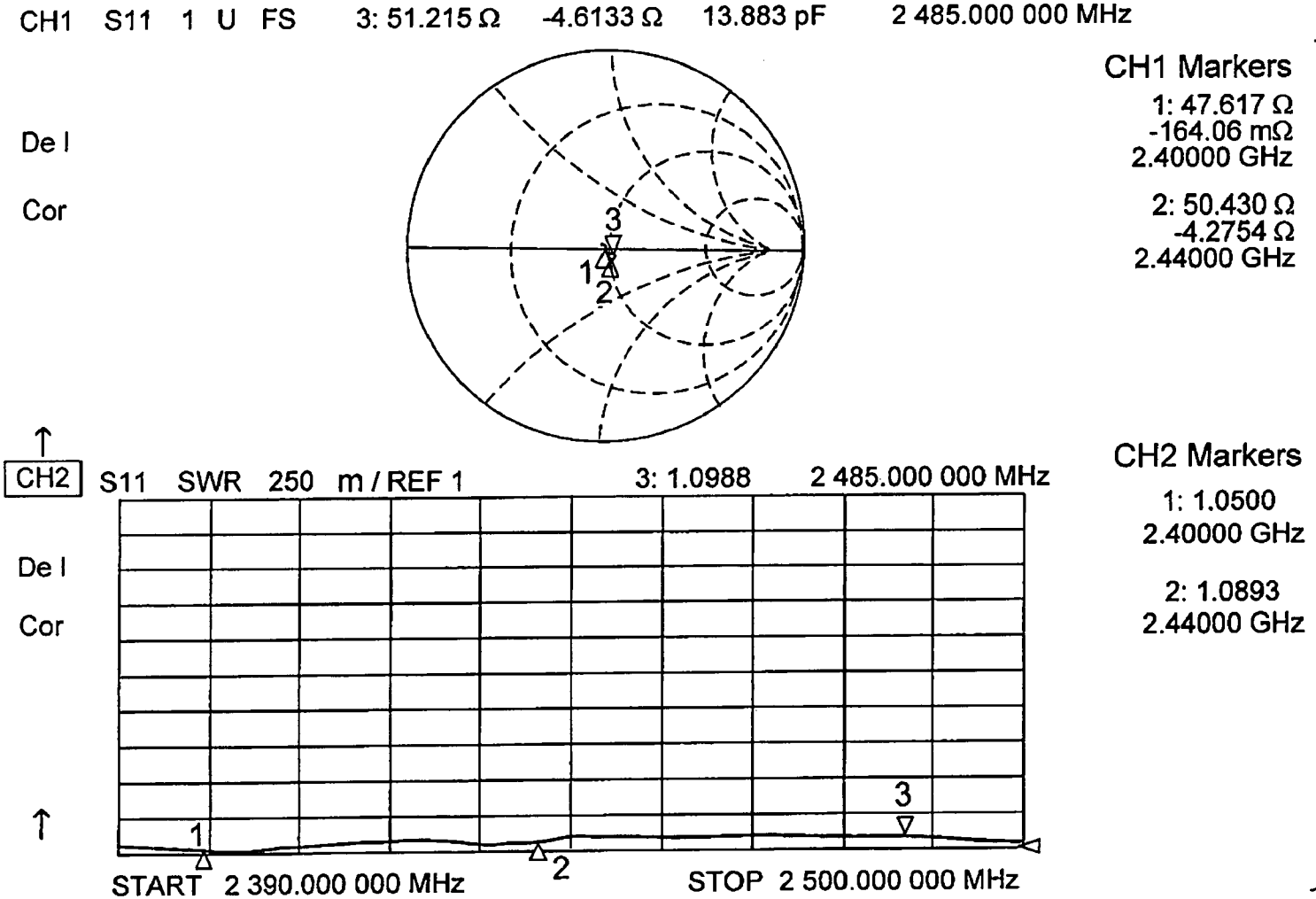
FIG. 10 shows an exemplary VSWR (S11) for the ISM band.

FIGS. 8–10 show exemplary VSWR (S11) plots against which the universal dipole 1 according to the present invention maybe tested to determine that its operating characteristics match the desired characteristics. FIGS. 11–15 show exemplary antenna pattern against which the universal dipole 1 according to the present invention maybe tested to determine that its operating characteristics match the desired characteristics.

Figure 16:
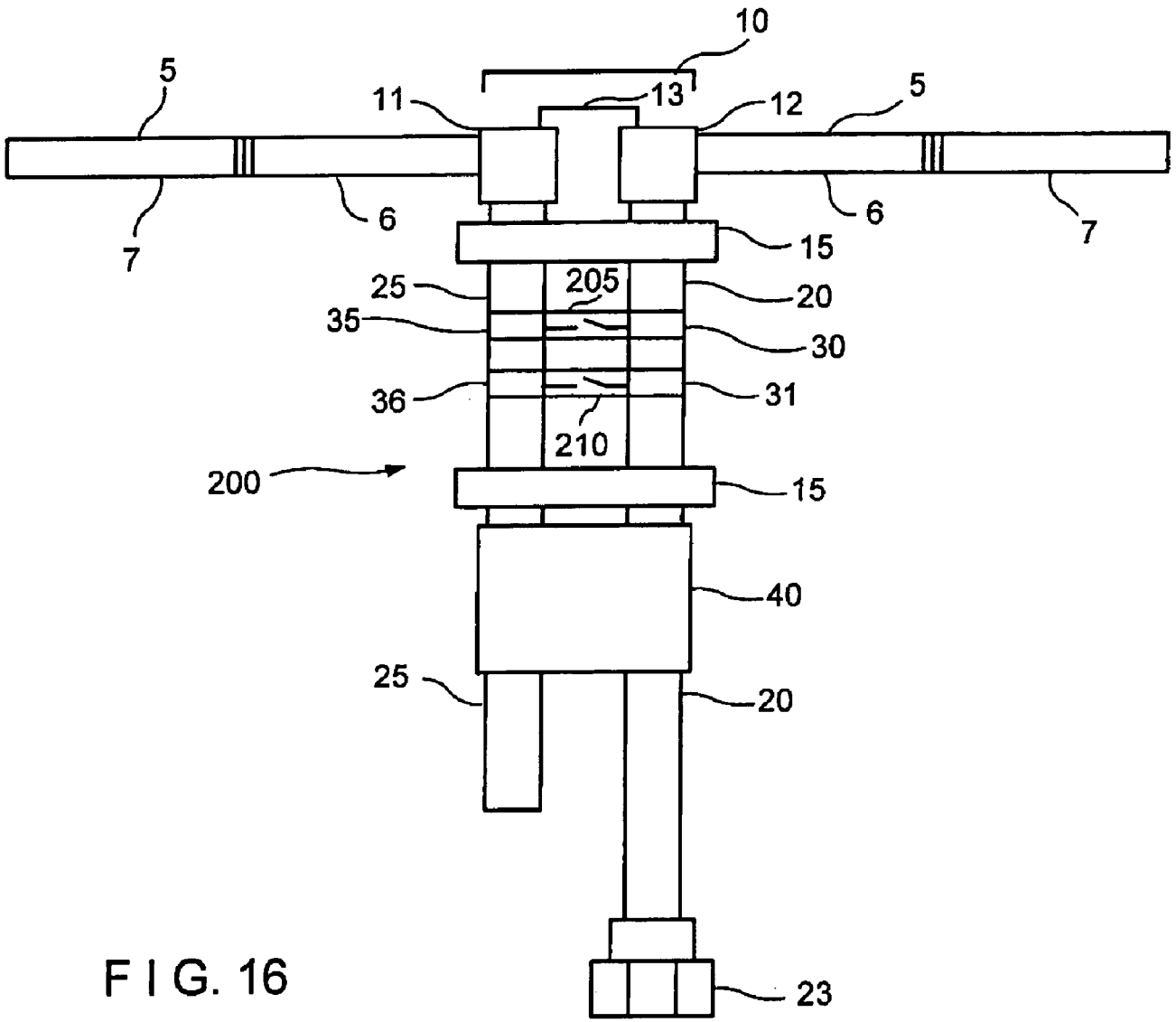
FIG. 16 shows a second exemplary embodiment of a universal dipole according to the present invention.

FIG. 16 shows a second exemplary embodiment of a universal dipole 200 according to the present invention. The universal dipole 200 has the same elements as the exemplary universal dipole 1, except that there is no sliding short assembly 45 and switch elements 205 and 210 have been added. The switch element 205 spans between locations 30 and 35 and the switch element 210 spans between locations 31 and 36. The switch elements 205 and 210 are conductors which contain a normally open switch. In the normal position, the switch elements 205 and 210 do not effect the universal dipole 200. However, when a user of the universal dipole 200 closes one of the switches of the switching elements 205 and 210, the user can create a short circuit between the feed line 20 and the balun 25 at the desired location. Thus, the switch elements 205 and 210 act in the same manner as the sliding short assembly 45 of universal dipole 1, except that the switch elements 205 and 210 may be permanently mounted to the feed line 20 and balun 25. The switching elements 205 and 210 may be connected to the outer conductor of the feed line 20 and balun 25 by soldering to form an electrical connection so that when the switch is closed, a short is formed at the location.

Again, in the exemplary universal dipole 200, two switching elements 205 and 210 are shown. However, a universal dipole according to the present invention may include any number of switching elements at various locations along the feed line 20 and balun 25 to create a short circuit at various lengths. Thus, to carry through with the examples from above, switching element 210 may be permanently connected at a distance of 2.44 inches from the bottom edge of the center section 10 to accommodate the DCS/PCS band and switching element 205 may be permanently connected at a distance of 1.14 inches from the bottom edge of the center section 10 to accommodate the ISM band.

The present invention has been described with the reference to the above exemplary embodiments. One skilled in the art would understand that the present invention may also be successfully implemented if modified. Accordingly, various modifications and changes may be made to the embodiments without departing from the broadest spirit and scope of the present invention as set forth in the claims that follow. The specification and drawings, accordingly, should be regarded in an illustrative rather than restrictive sense.

What is claimed is:

1. A dipole, comprising:

a feed line coupled to a first fitting;

a balun coupled to a second fitting;

a first variable length antenna element coupled to the first fitting;

a second variable length antenna element coupled to the second fitting;

a support plate holding the feed line and the balun at a fixed spacing, the support plate including a short circuit path between the feed line and the balun; and a sliding short assembly attachable between the feed line and the balun to create a short circuit at variable distances along the feed line and the balun.

2. The dipole of claim 1, wherein each of the variable distances along the feed line and the balun correspond to a receiving frequency band of the universal dipole.

3. The dipole of claim 2, wherein the receiving frequency is one of an Advanced Mobile Phone System frequency band, a Global System for Mobile Communication frequency band, a Digital Cellular System frequency band, a Personal Communication Services frequency band and an Industrial, Scientific and Medical frequency band.

4. The dipole of claim 1, wherein each of the variable antenna lengths of the first and second antenna elements correspond to a receiving frequency band of the universal dipole.

5. The dipole of claim 1, wherein the first antenna element includes a plurality of releaseably connectable conducting segments, the variable lengths of the first antenna elements being created by connecting a set of the plurality of conducting segments.

6. The dipole of claim 5, wherein each of the segments is an aluminum hexagonal standoff having a length of substantially 1 inch.

7. The dipole of claim 1, wherein the first antenna element is constructed of a conducting material including one of aluminum, brass and copper.

8. The dipole of claim 1, wherein the first fitting and the second fitting are coupled and the feed line is further coupled to the second fitting.

9. The dipole of claim 1, wherein the feed line is one of a semi-rigid coaxial cable and a rigid coaxial cable.

10. The dipole of claim 1, further comprising:

a spacer holding the feed line and the balun at the fixed spacing.

11. A dipole, comprising:

a set of variable length antenna elements;

a feed line;

a balun;

a short circuit assembly creating short circuits at variable distances along the feed line and the balun, wherein each of the variable distance short circuits and each of the variable length antenna elements correspond to a receiving frequency of the universal dipole, and wherein the short circuit assembly includes a sliding short assembly which is releaseably connected between the feed line and the balun at the variable distances.

12. The dipole of claim 11, wherein the short circuit assembly includes fixed switch elements at each of the variably distances, each of the fixed switch elements including a switch which closes to create the short circuit at the variable distance.

13. The dipole of claim 11, wherein the dipole conducts a received signal to a connected device.

14. The dipole of claim 11, further comprising:

a support plate holding the feed line and the balun at a fixed spacing and creating a permanent short circuit between the feed line and the balun.

15. The dipole of claim 11, wherein a first variable distance corresponds to one of an Advanced Mobile Phone System frequency band and a Global System for Mobile Communication frequency band, a second variable distance corresponds to one of a Digital Cellular System frequency band and a Personal Communication Services frequency band, and a third variable distance corresponds to an Industrial, Scientific and Medical frequency band.

16. The dipole of claim 11, wherein each of set of antenna elements includes a plurality of releaseably connectable conducting segments, the variable lengths of the antenna elements being created by connecting a set of the plurality of conducting segments.

17. The dipole of claim 16, wherein the set of the segments includes two segments for one of an Advanced Mobile Phone System frequency band and a Global System for Mobile Communication frequency band, the set of segments includes one segment for one of a Digital Cellular System frequency band and a Personal Communication Services frequency band, and the set of segments includes zero segments for an Industrial, Scientific and Medical frequency band.

18. A dipole antenna connectable to a device for receiving and transmitting signals, the dipole antenna comprising:

a variable length antenna element to receive signals transmitted to the device;

a feed line to conduct the received signals to the device;

a balun and a short circuit assembly; wherein the short circuit assembly creating variable length short circuits between the feed line and the balun;

a signal balancing element to optimize the dipole antenna performance for a plurality of frequency signals, wherein the antenna element includes a plurality of releaseably connectable conducting segments, the antenna element being created by connecting a set of the plurality of conducting segments.

* * * * *